US011267144B2

(12) United States Patent
Zhou

(10) Patent No.: US 11,267,144 B2
(45) Date of Patent: Mar. 8, 2022

(54) UTILITY KNIFE WITH A LOCKNUT

(71) Applicant: NINGBO HONGDI MEASURING TAPE INDUSTRY CO., LTD, Zhejiang (CN)

(72) Inventor: Xiaogang Zhou, Zhejiang (CN)

(73) Assignee: NINGBO HONGDI MEASURING TAPE INDUSTRY CO., LTD., Zhejiang (CN)

( * ) Notice: Subject to any disclaimer, the term of this patent is extended or adjusted under 35 U.S.C. 154(b) by 83 days.

(21) Appl. No.: 16/646,729

(22) PCT Filed: Sep. 14, 2018

(86) PCT No.: PCT/CN2018/105711
§ 371 (c)(1),
(2) Date: Mar. 12, 2020

(87) PCT Pub. No.: WO2020/047891
PCT Pub. Date: Mar. 12, 2020

(65) Prior Publication Data

US 2020/0276722 A1 Sep. 3, 2020

(30) Foreign Application Priority Data

Sep. 6, 2018 (CN) ..... 201811037339.3
Sep. 6, 2018 (CN) ..... 201821455434.0

(51) Int. Cl.
*B26B 1/08* (2006.01)
*B26B 1/04* (2006.01)
*B26B 5/00* (2006.01)

(52) U.S. Cl.
CPC ..... *B26B 1/08* (2013.01); *B26B 1/048* (2013.01); *B26B 5/003* (2013.01)

(58) Field of Classification Search
None
See application file for complete search history.

(56) References Cited

U.S. PATENT DOCUMENTS 4,240,202 A * 12/1980 Gilbert ..... B26B 5/002 30/162
4,858,320 A * 8/1989 Lemaire ..... B26B 1/044 30/162

(Continued)

FOREIGN PATENT DOCUMENTS

CN 101659061 A 3/2010
CN 106272568 A 1/2017

(Continued)

OTHER PUBLICATIONS

International Search Report for International Application No. PCT/CN2018/105711 dated Dec. 6, 2018.

*Primary Examiner* — Hwei-Siu G Payer
(74) *Attorney, Agent, or Firm* — Tarolli, Sundheim, Covell & Tummino LLP

(57) ABSTRACT

A utility knife with a locknut includes a case, a blade holder, a blade, a movable pushbutton and a locking device. A blade extension/retraction opening is formed at a front end of the case and provided for the blade to extend or retract, and a movable chute is formed on a side of the case and provided for the movable pushbutton to move. The blade is correspondingly installed in the case by the blade holder, the blade controls its extension and retraction in the blade extension/retraction opening by the movable pushbutton. The locking device includes a locking rod and an adjusting device and uses the adjusting device to adjust the locking rod and lock the blade.

9 Claims, 17 Drawing Sheets

(56) References Cited

U.S. PATENT DOCUMENTS

| | | | | |
|---|---|---|---|---|
| 5,005,290 | A * | 4/1991 | Gilbert | B26B 5/001 30/125 |
| 8,413,339 | B2 * | 4/2013 | Ranieri | B26B 5/002 30/162 |
| 9,457,483 | B2 * | 10/2016 | Wu | B26B 1/08 |
| 2003/0150117 | A1 | 8/2003 | Owoc | |
| 2010/0037465 | A1 * | 2/2010 | Price | B26B 5/001 30/152 |
| 2010/0037466 | A1 * | 2/2010 | Rowlay | B26B 5/001 30/153 |
| 2011/0283542 | A1 * | 11/2011 | Wu | B26B 5/003 30/162 |
| 2012/0198703 | A1 * | 8/2012 | Ranieri | B26B 5/002 30/162 |
| 2020/0276722 | A1 * | 9/2020 | Zhou | B26B 5/002 |

FOREIGN PATENT DOCUMENTS

| | | | |
|---|---|---|---|
| CN | 2016748479 | U | 12/2017 |
| WO | WO 2020/107598 | A1 * | 6/2020 |

* cited by examiner

UTILITY KNIFE WITH A LOCKNUT

RELATED APPLICATIONS

The present invention is a U.S. National Stage under 35 USC 371 patent application, claiming priority to Ser. No. PCT/CN2018/105711, filed on 14 Sep. 2018; which claims priority of CN 201811037393, filed on 6 Sep. 2018 and CN 2018214554340, filed on 6 Sep. 2018, the entirety of which are incorporated herein by reference.

FIELD OF INVENTION

The present invention relates to the technical field of knives, in particular to a utility knife with a locknut.

BACKGROUND OF INVENTION

Description of the Related Art

Utility knife, also known as craving knife or wallpaper knife, is a knife generally used in the areas of fine arts and handcrafts and mainly used for cutting a relatively soft object, and most of such knives are comprised of a plastic knife handle and a blade and have a pull-out structure. There are also a few of them having a metal knife handle, and most of the blades have an oblique end and use a smooth blunt sheet body for drawing lines, cutting, and show a new blade to facilitate the use of the knife. In general, most conventional utility knives adopt a latching effect between a movable pushbutton and a locking serration formed on a blade chute to achieve the purpose of locking the blade. However, such locking structure is not particularly secured. When the movable pushbutton is touched by accident during the use of the knife, the blade may be released from the unlocked state easily, and an elastic resetting member may be malfunctioned during a locking process, so that the function of locking the blade is disabled. Furthermore, the blade may be shaken during the use of the knife because there is a gap existing between the blade and the blade chute. As a result, a general utility knife is not suitable for fine cutting.

SUMMARY OF THE INVENTION

Problem to be Solves

The present invention provides conventional utility knife with the features of simple structure and convenient operation and the function of locking the blade to overcome the aforementioned drawbacks of the prior art.

Technical Solution

To achieve the objective above, the present invention provides a utility knife with a locknut, comprising a case, a blade holder, a blade, a movable pushbutton and a locking device, characterized in that the case comprises a blade extension/retraction opening formed at a front end thereof and provided for the blade to extend or retract and a movable chute formed on a side of the case and provided for the movable pushbutton to move; the blade is correspondingly installed into the case through the blade holder, and the blade is controlled by the movable pushbutton to perform an extension or retraction at the blade extension/retraction opening; the locking device comprises a locking rod and an adjusting device, and the locking device adjusts the locking rod by the adjusting device to lock the blade.

Wherein, the case comprises: a blade holder slidable mounting groove formed on the front side of the case, penetrating through the bottom of the case and the blade extension/retraction opening, and matched with the blade holder; a blade chute formed on the front side of the blade holder, penetrating both sides of the blade holder, and matched with the blade; and a bevel upwardly formed at the bottom of a front section of the blade chute;

the blade holder being plugged from a rear end of the blade holder slidable mounting groove of the case into a position corresponsively matched and coupled to the case; the rear end of the blade corresponsively matched and coupled to the rear end and the movable pushbutton being movably installed into the blade chute of the blade holder, and the movable pushbutton being exposed from both of the top notches of the blade chute and the blade holder slidable mounting groove; the locking rod being installed between the bottom of the blade chute and the blade, and the adjusting device being installed at a rear end of the case; the locking rod performing an extension/retraction movement in the blade chute by the control of the adjusting device, and a front end of the locking rod reducing the gap between the locking rod and the blade by the bevel to lock the blade tightly.

Wherein, the blade chute of the blade holder has a plurality of symmetrically distributed locking serrated slots formed on two parallel sides thereof; the movable pushbutton comprises a bottom plate, a reset elastic plate, a locking shaft and a pushing portion; the bottom plate has a bump disposed at a front end thereof, and the blade has a hole formed at a rear end thereof and matched with the bump; the bottom plate has an elastic plate mounting slot formed at a front side of the rear end and matched with the reset elastic plate, and the elastic plate mounting slot further has an axis positioning slot formed thereon, perpendicularly intersected and matched with the locking shaft; the pushing portion has a V-shaped groove formed at a bottom end thereof and matched with the locking shaft;

the reset elastic plate is corresponsively installed into the elastic plate mounting slot of the bottom plate; the locking shaft is corresponsively installed into the axis positioning slot and disposed on the reset elastic plate, and a part of the locking shaft is protruded from a side of the bottom plate; the pushing portion is corresponsively latched onto the bottom plate, and the V-shaped groove is corresponsively sheathed onto the part of the bottom plate protruded from the locking shaft; the rear end of the blade and the movable pushbutton are coupled by the corresponsive engagement between the bump and the hole;

when no force is exerted onto the movable pushbutton, the part of the end of the locking shaft protruded from the bottom plate is corresponsively engaged with the locking serrated slot; when a force is exerted onto the movable pushbutton to push the movable pushbutton, a downward component force of the V-shaped groove squeezes and compresses the locking shaft to overcome the elastic force of the reset elastic plate, so as to deform and dent the reset elastic plate, while the locking shaft is being squeezed and pressed into the axis positioning slot, so that the locking shaft and the locking serrated slot are detached from each other.

Wherein, the adjusting device comprises a stop screw, a stop bracket and a lock knob; the stop bracket is a U-shaped structure, and a U-shaped open end of the stop bracket and the rear end of the locking rod are corresponsively hinged with each other; the lock knob has a threaded hole formed thereon and coaxially matched with the stop screw; and the stop bracket has a knob snapping slot formed on a U-shaped closed end side and matched with the lock knob, and the stop bracket has a screw socket formed on a U-shaped open bottom thereof, penetrating through the knob snapping slot, and matched with the stop screw; the lock knob is corresponsively engaged with the knob snapping slot of the stop bracket, and the lock knob in the knob snapping slot can rotate freely about an axis which is the axial line of the lock knob, and both of the threaded hole and the screw socket are coaxially distributed; the stop screw is corresponsively fixed to a rear end of the case, and the screw thread of the stop screw is configured in a direction opposite to the blade extension/retraction opening; the blade holder slidable mounting groove has a bracket moving slot formed separately on both sides of the rear end thereof and matched with the stop bracket; the locking rod achieves an extension/retraction movement in the blade chute by adjusting a screw thread connection between the lock knob and the stop screw.

Wherein, the case has a stopping and positioning notch formed separately on both sides of the rear end thereof, and the stop bracket has a stop positioning block disposed separately on both sides thereof and matched with the stopping and positioning notch; when the gap between the front end of the locking rod and the blade is reduced by the bevel to lock the blade tightly, the stopping and positioning notch and the stop positioning block have a corresponding gap formed therebetween.

Wherein, the case comprises an outer case and an inner case; both of the blade extension/retraction opening and the blade holder slidable mounting groove are disposed on the outer case, the blade holder slidable mounting groove has a case socket formed at the bottom thereof and matched with the inner case;

the inner case has a blade holder chute matched with the blade holder; after the inner case is corresponsively engaged with the case socket, the inner case passes through the blade holder and penetrates through the blade holder slidable mounting groove and the blade holder chute to fix the inner case onto the outer case.

Wherein, the case comprises a left case and a right case engaged sideway and fixed with each other, and the right case has a blade holder sliding groove formed on an inner wall thereof, penetrating through the blade extension/retraction opening, and matched with the blade holder; the case has a movable pushbutton chute formed at a top side thereof, penetrating through the blade holder sliding groove, and matched with the movable pushbutton; the left case has an oblique bump disposed on an inner wall thereof and at a position near the blade extension/retraction opening; the blade is fixedly engaged with the blade holder, and the blade holder carrying the blade is corresponsively installed to the blade holder sliding groove; the movable pushbutton is corresponsively linked and coupled to the blade holder and exposed from the case at a position of the movable pushbutton chute; the locking rod is installed between the inner wall of the left case and the blade, and the adjusting device is installed at a rear end of the case; the locking rod achieves an extension/retraction movement in a direction with respect to the blade extension/retraction opening by the control of the adjusting device, and a front end of the locking rod reduces the gap between the locking rod and the blade by the oblique bump to lock the blade tightly.

Wherein, the movable pushbutton comprises a connecting rod and a pushing portion integrally coupled with each other, and the blade holder has a linkage socket formed thereon for corresponsively sheathing on the connecting rod; the blade holder sliding groove of the right case has a plurality of equidistant positioning serrated slots formed at a top edge thereof, and a plurality of positioning bumps disposed at a side edge of the connecting rod and corresponsively matched with the positioning serrated slots respectively;

the movable pushbutton achieves the linkage and connection with the blade holder by corresponsively sheathing the linkage socket on the connecting rod, and the axial direction of the linkage socket is in the direction of the opening of the movable pushbutton chute; the pushing portion is exposed from case at the position of the movable pushbutton chute; a reset elastic member having the direction of action force which is the same as the axial direction of the linkage socket is installed between the movable pushbutton and the blade holder, and the positioning bump is engaged with one of the positioning serrated slots under the action force of the reset elastic member; when the movable pushbutton is pressed, the movable pushbutton overcomes the downward reset force of the reset elastic member, so that the positioning bump is detached from the positioning serrated slot, so as to push the movable pushbutton to drive the blade holder with the blade to perform an extension/retraction movement in the blade holder sliding groove;

when the blade is retracted to a position to release the movable pushbutton, the positioning bump under the reset force of the reset elastic member is engaged with one of the positioning serrated slots.

Wherein, the blade has a locking hole formed thereon and corresponsively engaged with the blade holder; the left case has a blade changing button installed on an inner sidewall thereon, and the blade changing button has an end corresponsively engaged with the left case and the other end penetrating through the left case and extending out from an outer side of the left case, and the locking hole is corresponsively sheathed on a back structure of an end of the blade changing button extended out from the left case.

Wherein, the adjusting device comprises a stop screw and a lock knob, and the lock knob has a threaded hole coaxially matched with the stop screw; the case has a knob socket formed at a bottom end thereof and matched with the lock knob; the lock knob is corresponsively engaged into the knob socket; a front end of the stop screw is corresponsively and fixedly coupled to a rear and of the locking rod, and the rear end of the stop screw and the threaded hole of the lock knob are corresponsively coupled by a screw thread; the locking rod is coupled by the screw thread between the lock knob and the stop screw to adjust an extension/retraction movement in a direction with respect to the blade extension/retraction opening.

Beneficial Effects

Compared with the prior art,

The structure of the locking rod locks the blade tightly to achieve the function of locking the blade to prevent the blade from extending/retracting or sliding and save the user's effort of manually pressing and limiting the blade for its operation. The invention effectively prevents the blade from sliding freely or injuring users or others accidentally. Further, a nut with the structure of the screw thread is provided for locking and making adjustment of the blade. The invention has the features of a simple structure and a convenient operation.

DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
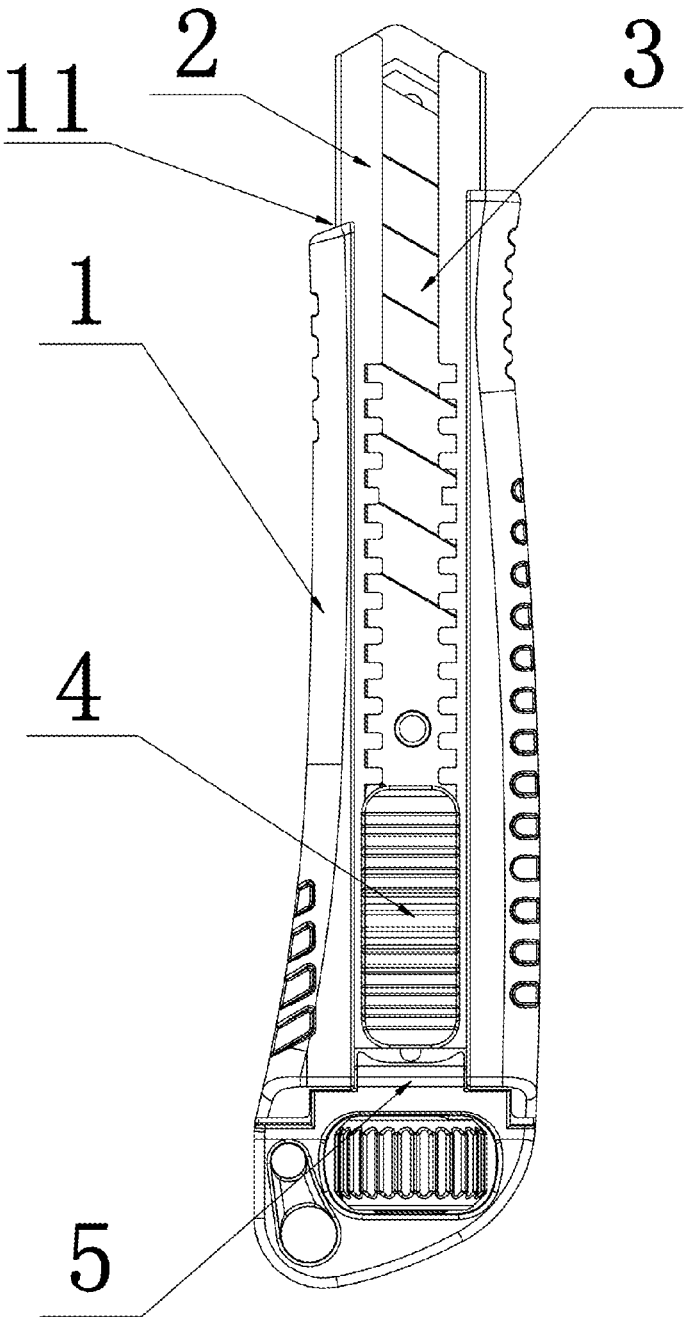
FIG. 1 is a schematic view of a utility knife with a locknut in accordance with the present invention.
Figure 2:
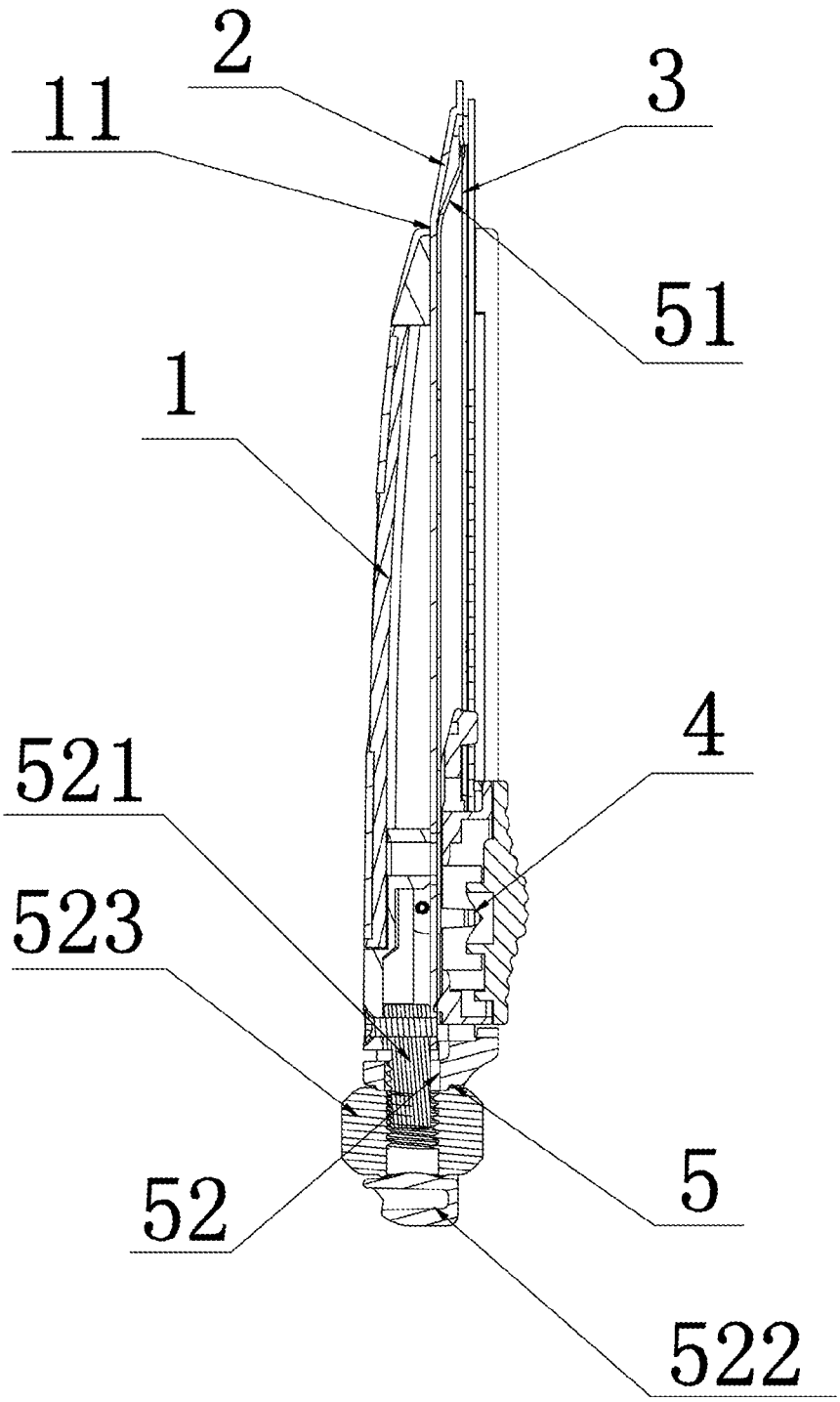
FIG. 2 is a cross-sectional view of a utility knife with a locknut in accordance with the present invention.
Figure 3:
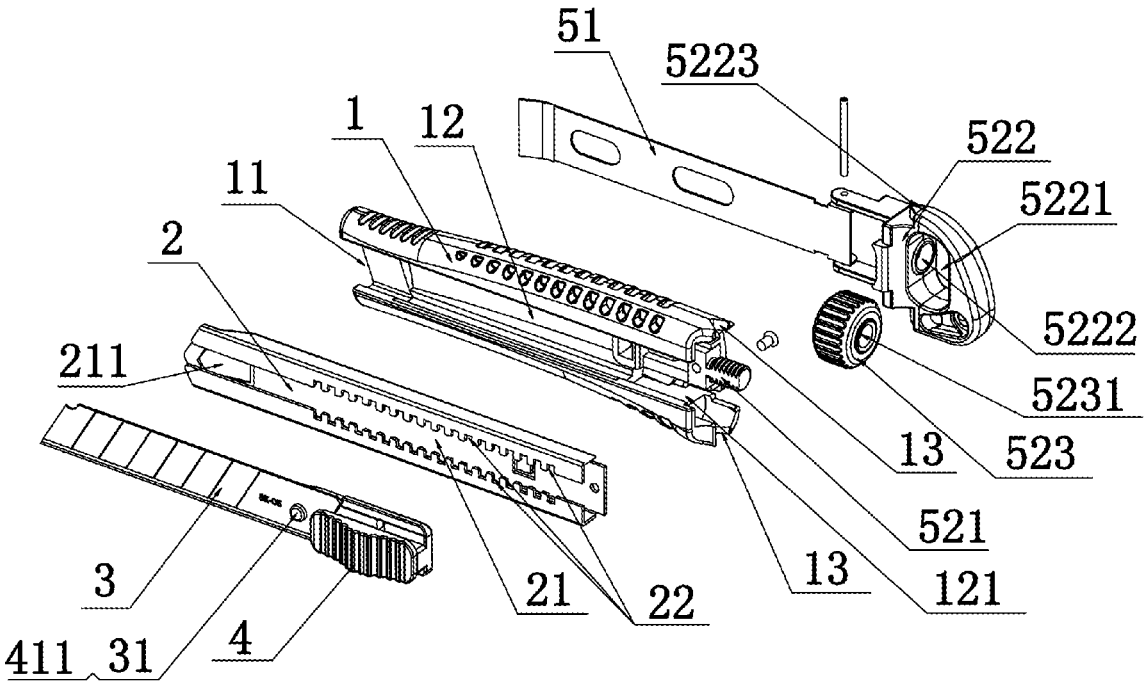
FIG. 3 is an exploded view of a utility knife in accordance with a locknut of the present invention.
Figure 4:
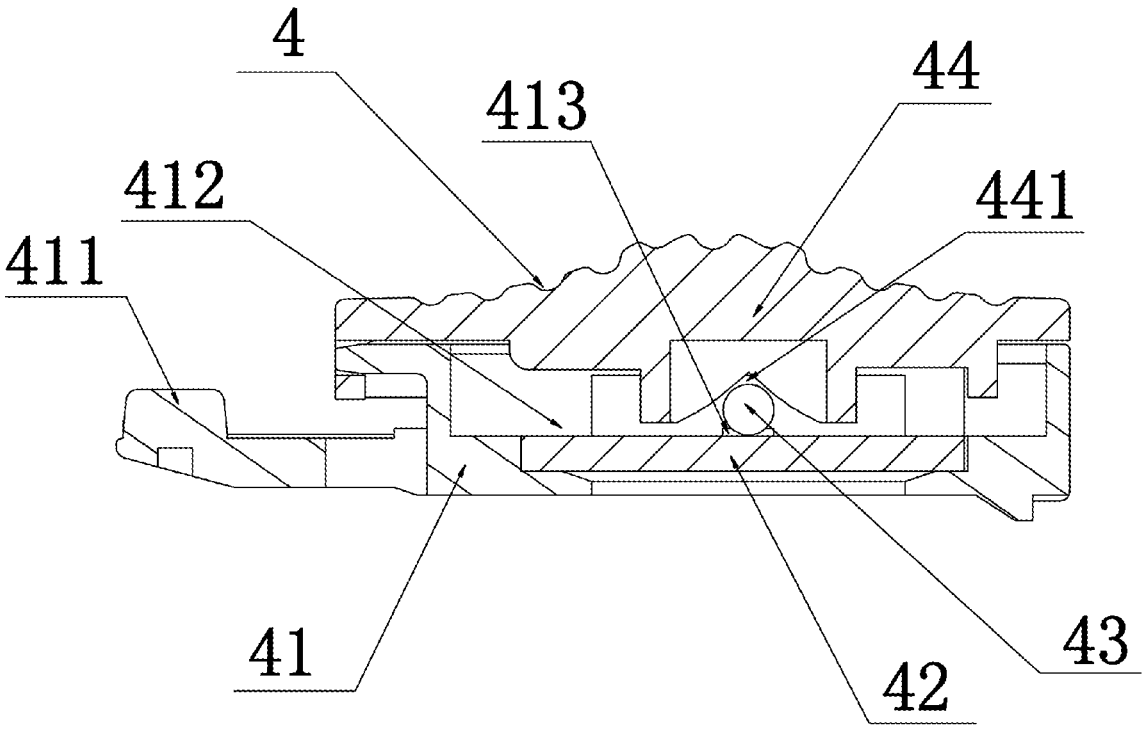
FIG. 4 is a schematic view of a movable pushbutton of a utility knife with a locknut in accordance with the present invention.
Figure 5:
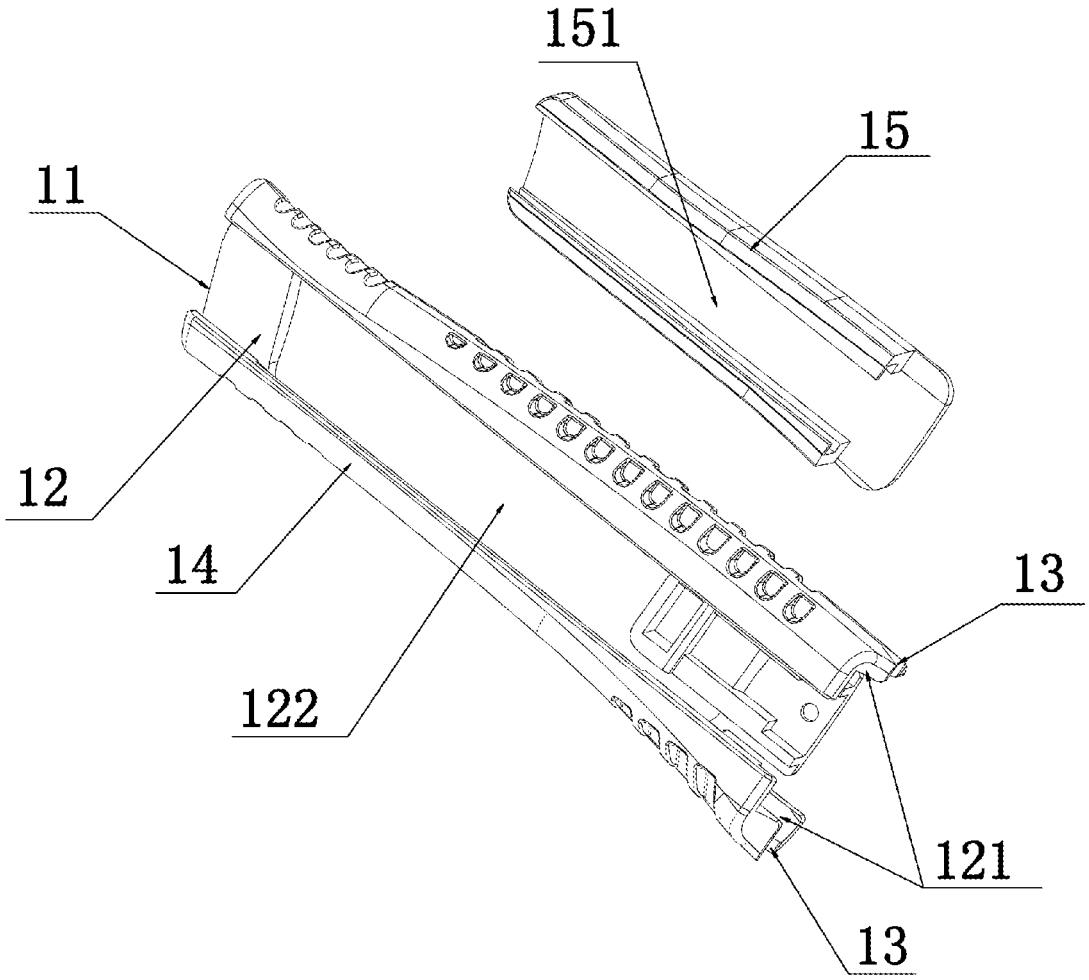
FIG. 5 is a schematic view of a case of a utility knife with a locknut in accordance with the present invention.
Figure 6:
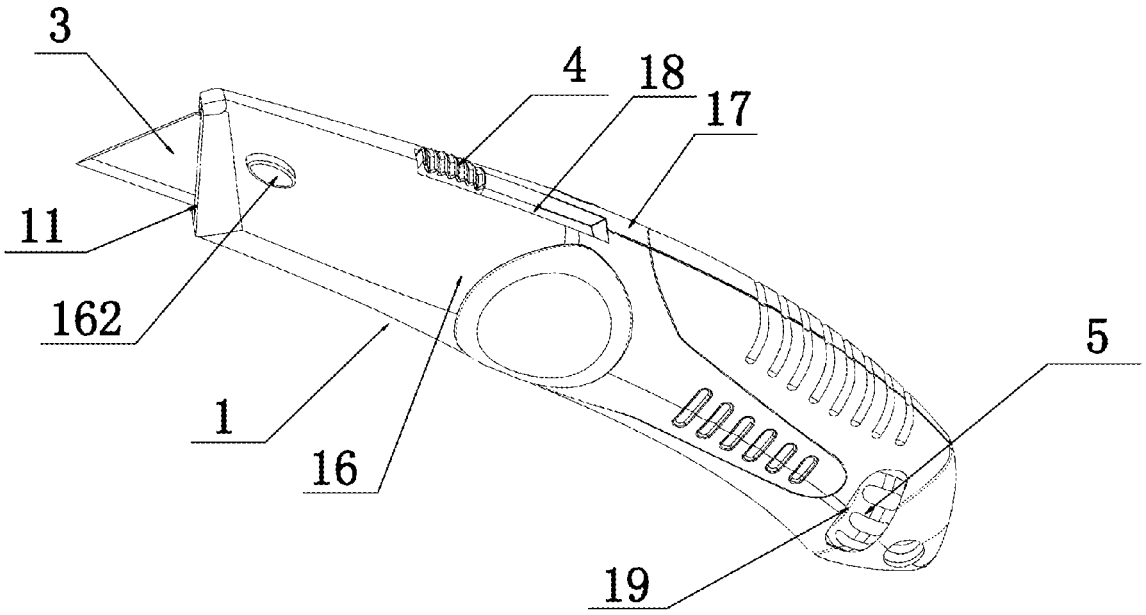
FIG. 6 is a schematic view of another utility knife with a locknut in accordance with the present invention.
Figure 7:
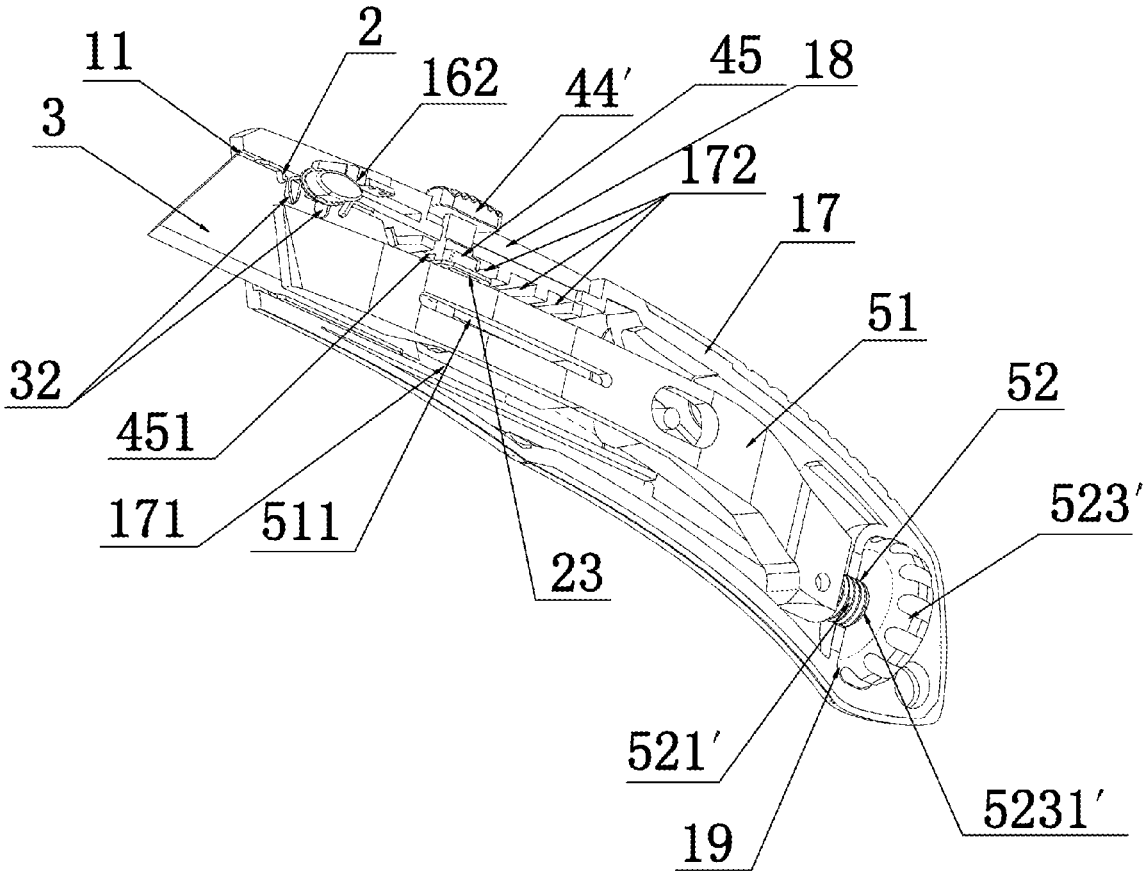
FIG. 7 is a schematic view of another utility knife with a locknut and without a left case in accordance with the present invention.
Figure 8:
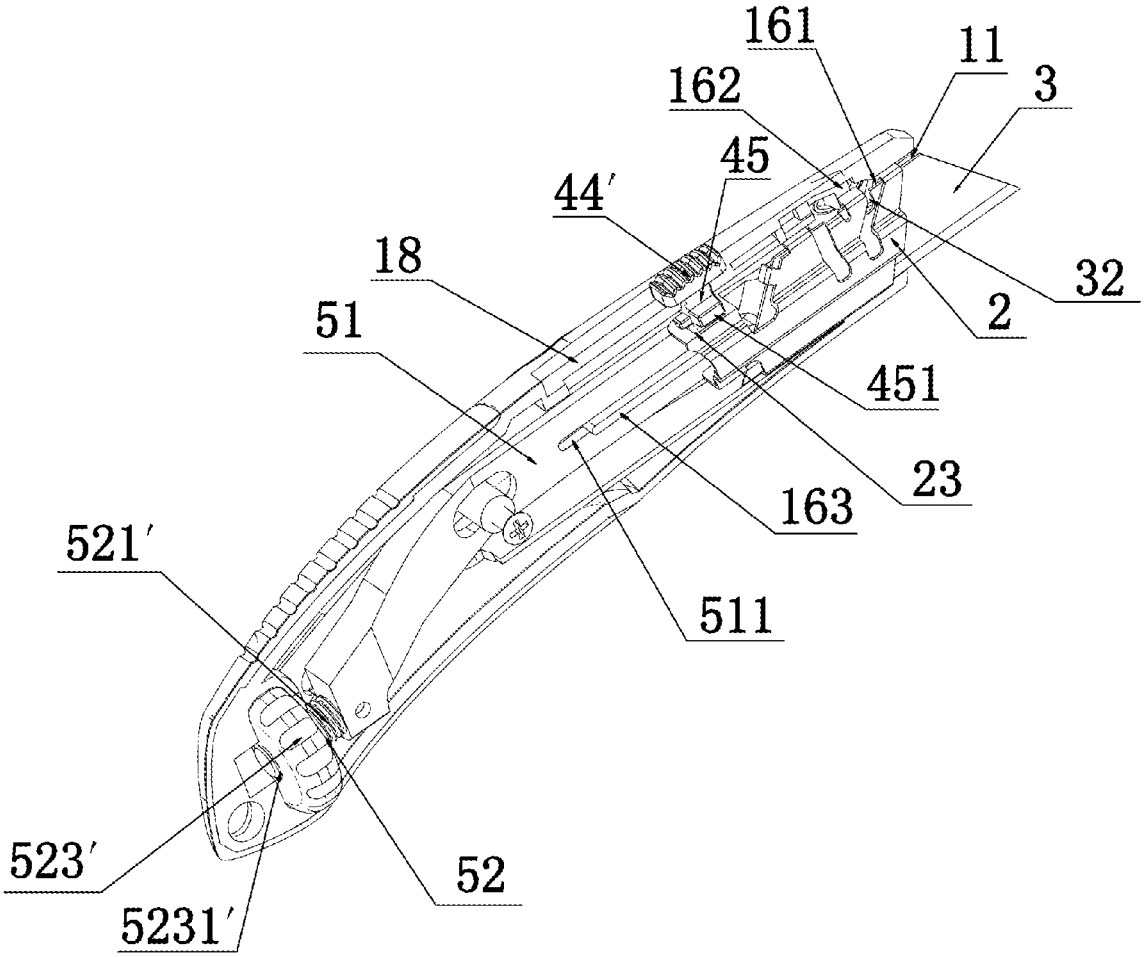
FIG. 8 is a schematic view of another utility knife with a locknut and without a right case in accordance with the present invention.

With reference to FIGS. 1 to 3 for a schematic view, a cross-sectional view, and an exploded view of a utility knife with a locknut of the present invention respectively, FIG. 4 for a schematic view of a movable pushbutton of a utility knife with a locknut of the invention, FIG. 5 for a case of a utility knife with a locknut of the invention, FIG. 6 for another utility knife with a locknut of the invention, FIG. 7 is a schematic view of a utility knife with a locknut and without a left case of the invention, FIG. 8 is a schematic view of a utility knife with a locknut and without a right case of the invention, the utility knife with a locknut comprises a case 1, a blade holder 2, a blade 3, a movable pushbutton 4 and a locking device 5; characterized in that the case 1 comprises a blade extension/retraction opening 11 formed at a front end thereof and provided for the blade 3 to extend or retract and a movable chute formed on a side of the case 1 and provided for the movable pushbutton 4 to move; the blade 3 is correspondingly installed into the case 1 through the blade holder 2, and the blade 3 is controlled by the movable pushbutton 4 to perform an extension or retraction at the blade extension/retraction opening 11; the locking device 5 comprises a locking rod 51 and an adjusting device 52, and the locking device 5 adjusts the locking rod 51 by the adjusting device 52 to lock the blade 3.

In the aforementioned structure of the present invention, the locking rod is provided for locking the blade securely, so that the blade will not be shifted or shaken when the utility knife is used for cutting, and the invention effectively improve the stability of using the utility knife and prevent the blade from extending, retracting, or shaking freely that may cause errors to the cutting or injuring the user or others accidentally. Such utility knife is suitable for high precision cutting and capable of improving the safety performance.

With reference to FIGS. 1, 2 and 3 for an embodiment of this invention, the case 1 comprises a blade holder slidable mounting groove 12 formed on the front side of the case 1, penetrating through the bottom of the case 1 and the blade extension/retraction opening 11, and matched with the blade holder 2; a blade chute 21 formed on the front side of the blade holder 2, penetrating both sides of the blade holder 2, and matched with the blade 3; and a bevel 211 upwardly formed at the bottom of a front section of the blade chute 21; the blade holder 2 being plugged from a rear end of the blade holder slidable mounting groove 12 of the case 1 into a position corresponsively matched and coupled to the case 1; the rear end of the blade 3 corresponsively matched and coupled to the rear end and the movable pushbutton 4 being movably installed into the blade chute 21 of the blade holder 2, and the movable pushbutton 4 being exposed from both of the top notches of the blade chute 21 and the blade holder slidable mounting groove 12; the locking rod 51 being installed between the bottom of the blade chute 21 and the blade 3, and the adjusting device 52 being installed at a rear end of the case 1; the locking rod 51 performing an extension/retraction movement in the blade chute 21 by the control of the adjusting device 52, and a front end of the locking rod 51 reducing the gap between the locking rod 51 and the blade 3 by the bevel 211 to lock the blade 3 tightly. In the present invention, the gap between the locking rod and the blade is reduced to achieve the effect of locking the blade tightly, so as to limit the extension/retraction movement of the blade and the shaking of the blade in the gap effectively and ensure a secured lock of the blade.

In this embodiment as shown in FIGS. 3 and 4, the blade chute 21 of the blade holder 2 has a plurality of symmetrically distributed locking serrated slots 22 formed on two parallel sides thereof; the movable pushbutton 4 comprises a bottom plate 41, a reset elastic plate 42, a locking shaft 43 and a pushing portion 44; the bottom plate 41 has a bump 411 disposed at a front end thereof, and the blade 3 has a hole 31 formed at a rear end thereof and matched with the bump 411; the bottom plate 41 has an elastic plate mounting slot 412 formed at a front side of the rear end and matched with the reset elastic plate 42, and the elastic plate mounting slot 412 further has an axis positioning slot 413 formed thereon, perpendicularly intersected and matched with the locking shaft 43; the pushing portion 44 has a V-shaped groove 441 formed at a bottom end thereof and matched with the locking shaft 43; the reset elastic plate 42 is corresponsively installed into the elastic plate mounting slot 412 of the bottom plate 41; the locking shaft 43 is corresponsively installed into the axis positioning slot 413 and disposed on the reset elastic plate 42, and a part of the locking shaft 43 is protruded from a side of the bottom plate 41; the pushing portion 44 is corresponsively latched onto the bottom plate 41, and the V-shaped groove 441 is corresponsively sheathed onto the part of the bottom plate 41 protruded from the locking shaft 43; the rear end of the blade 3 and the movable pushbutton 4 are coupled by the corresponsive engagement between the bump 411 and the hole 31; when no force is exerted onto the movable pushbutton 4, the part of the end of the locking shaft 43 protruded from the bottom plate 41 is corresponsively engaged with the locking serrated slot 22; when a force is exerted onto the movable pushbutton 4 to push the movable pushbutton 4, a downward component force of the V-shaped groove 441 squeezes and compresses the locking shaft 43 to overcome the elastic force of the reset elastic plate 42, so as to deform and dent the reset elastic plate 42, while the locking shaft 43 is being squeezed and pressed into the axis positioning slot 413, so that the locking shaft 43 and the locking serrated slot 22 are detached from each other and the movable pushbutton 4 is pushed to achieve the effect of extending or retracting the blade 3. In the present invention, the engagement and disengagement between the locking shaft of the movable pushbutton and the locking serrated slot is used to achieve the effect of extending, retracting or locking the blade. Wherein, the reset elastic plate 42 can be substituted by any equivalent elastic device such as a spring, or an elastic object made of rubber.

In the embodiment as shown in FIGS. 1, 2 and 3, the adjusting device 52 comprises a stop screw 521, a stop bracket 522 and a lock knob 523; the stop bracket 522 is a U-shaped structure, and a U-shaped open end of the stop bracket 522 and the rear end of the locking rod 51 are corresponsively hinged with each other, wherein the stop bracket 522 can be rotated about an axis at the hinge of the locking rod 51, so as to prevent the stop bracket 522 from hindering the blade 3 when it is necessary to change the blade 3; the lock knob 523 has a threaded hole 5231 formed thereon and coaxially matched with the stop screw 521; and the stop bracket 522 has a knob snapping slot 5221 formed on a U-shaped closed end side and matched with the lock knob 523, and the stop bracket 522 has a screw socket 5222 formed on a U-shaped open bottom thereof, penetrating through the knob snapping slot 5221, and matched with the stop screw 521; the lock knob 523 is corresponsively engaged with the knob snapping slot 5221 of the stop bracket 522, and the lock knob 523 in the knob snapping slot 5221 can rotate freely about an axis which is the axial line of the lock knob 523, and both of the threaded hole 5231 and the screw socket 5222 are coaxially distributed; the stop screw 521 is corresponsively fixed to a rear end of the case 1, and the screw thread of the stop screw 521 is configured in a direction opposite to the blade extension/retraction opening 11; the blade holder slidable mounting groove 12 has a bracket moving slot 121 formed separately on both sides of the rear end thereof and matched with the stop bracket 522; the locking rod 51 achieves an extension/retraction movement in the blade chute 21 by adjusting a screw thread connection between the lock knob 523 and the stop screw 521.

In the present invention, the adjusting device uses the screw thread connection structure to display the stop screw and drive the locking rod to perform an extension/retraction movement along the blade extension/retraction direction. The invention has the features of a simple structure, a convenient operation, and an economical and practical use. Wherein, the hinge structure between the rear end of the locking rod 51 and the U-shaped open end of the stop bracket 522 is installed under the locking rod 51 and disposed at the front of the stop screw 521, so that the blade 3 will not be hindered by the hinge structure during the process of changing the blade 3, and the stop screw 521 is provided for limiting the extension, retraction, or displacement of the locking rod 51 to prevent the stop bracket 522 together with the locking rod 51 from being drawn out from the case 1. In addition, the stop screw 521 can be fixed onto the case 1 by screws.

In this embodiment as shown in FIG. 3, the case 1 has a stopping and positioning notch 13 formed separately on both sides of the rear end thereof, and the stop bracket 522 has a stop positioning block 5223 disposed separately on both sides thereof and matched with the stopping and positioning notch 13; when the gap between the front end of the locking rod 51 and the blade 3 is reduced by the bevel 211 to lock the blade 3 tightly, the stopping and positioning notch 13 and the stop positioning block 5223 have a corresponding gap formed therebetween which is reserved as a secured locking interval for a loosened structure after a long time of use. In the present invention, the stopping and positioning notch and the matched stop positioning block provide a guiding function. Wherein, the stopping and positioning notch 13 can be a V-shaped open notch.

In this embodiment as shown in FIG. 5, the case 1 comprises an outer case 14 and an inner case 15; both of the blade extension/retraction opening 11 and the blade holder slidable mounting groove 12 are disposed on the outer case 14, and the blade holder slidable mounting groove 12 has a case socket 122 formed at the bottom thereof and matched with the inner case 15; the inner case 15 has a blade holder chute 151 matched with the blade holder 2; after the inner case 15 is corresponsively engaged with the case socket 122, the inner case 15 passes through the blade holder 2 and penetrates through the blade holder slidable mounting groove 12 and the blade holder chute 151 to fix the inner case 15 onto the outer case 14. The present invention divides the case into the outer case and the inner case, so that the outer and inner cases can be made of two different materials. For example, the outer case is made of metal and the inner case is made of plastic, and such structure can ensure the firmness of the case and prevent the case from falling, hit, or damaged. Further, the weight of such case can be reduced (when compared with the whole case made of material), so that a weaker user still can use the utility knife easily.

In FIGS. 6, 7 and 8, the case 1 comprises a left case 16 and a right case 17 engaged sideway and fixed with each other, and the right case 17 has a blade holder sliding groove 171 formed on an inner wall thereof, penetrating through the blade extension/retraction opening 11, and matched with the blade holder 2; the case 1 has a movable pushbutton chute 18 formed at a top side thereof, penetrating through the blade holder sliding groove 171, and matched with the movable pushbutton 4; the left case 16 has an oblique bump 161 disposed on an inner wall thereof and at a position near the blade extension/retraction opening 11; the blade 3 is fixedly engaged with the blade holder 2, and the blade holder 2 carrying the blade 3 is corresponsively installed to the blade holder sliding groove 171; the movable pushbutton 4 is corresponsively linked and coupled to the blade holder 2 and exposed from the case at a position of the movable pushbutton chute 18; the locking rod 51 is installed between the inner wall of the left case 16 and the blade 3, and the adjusting device 52 is installed at a rear end of the case 1; the locking rod 51 achieves an extension/retraction movement in a direction with respect to the blade extension/retraction opening 11 by the control of the adjusting device 52, and a front end of the locking rod 51 reduces the gap between the locking rod 51 and the blade 3 by the oblique bump 161 to lock the blade 3 tightly. The present invention adopts the aforementioned structure, so that users can hold the utility knife with the blade pointing downward and use a thumb to press the movable pushbutton in order to limit the extension and retraction of the blade for the cutting process, and allow the users to hold the utility knife more comfortable for its use Wherein, the oblique bump 161 is disposed between the blade 3 and the locking rod 51.

In FIGS. 7 and 8, the movable pushbutton 4 comprises a connecting rod 45 and a pushing portion 44' integrally coupled with each other, and the blade holder 2 has a linkage socket 23 formed thereon for corresponsively sheathing on the connecting rod 45; the blade holder sliding groove 171 of the right case 17 has a plurality of equidistant positioning serrated slots 172 formed at a top edge thereof, and a plurality of positioning bumps 451 disposed at a side edge of the connecting rod 45 and corresponsively matched with the positioning serrated slots 172 respectively; the movable pushbutton 4 achieves the linkage and connection with the blade holder 2 by corresponsively sheathing the linkage socket 23 on the connecting rod 45, and the axial direction of the linkage socket 23 is in the direction of the opening of the movable pushbutton chute 18; the pushing portion 44' is exposed from case 1 at the position of the movable pushbutton chute 18; a reset elastic member having the direction of action force which is the same as the axial direction of the linkage socket 23 is installed between the movable pushbutton 4 and the blade holder 2, and the positioning bump 451 is engaged with one of the positioning serrated slots 172 under the action force of the reset elastic member; when the movable pushbutton 4 is pressed, the movable pushbutton 4 overcomes the downward reset force of the reset elastic member, so that the positioning bump 451 is detached from the positioning serrated slot 172, so as to push the movable pushbutton 4 to drive the blade holder 2 with the blade 3 to perform an extension/retraction movement in the blade holder sliding groove 171; when the blade 3 is retracted to a position to release the movable pushbutton 4, the positioning bump 451 under the reset force of the reset elastic member is engaged with one of the positioning serrated slots 172. When the blade 3 is retracted to a position to release the movable pushbutton 4, the positioning bump 451 under the reset force of the reset elastic member is engaged with one of the positioning serrated slots 172. Wherein, the reset elastic member can be an integral string structure. In addition, there are two linkage sockets 23 formed on the blade holder 2 and the two linkage sockets 23 are coaxially distributed to ensure the stability of engaging the connecting rod 45, and the spring structure can be corresponsively sheathed on the connecting rod 45 and acted between the linkage socket 23 and the connecting rod 45, so as to achieve the function of restoring the movable pushbutton 4 with respect to the blade holder 2.

In FIGS. 7 and 8, the blade 3 has a locking hole 32 formed thereon and corresponsively engaged with the blade holder 2; the left case 16 has a blade changing button 162 installed on an inner sidewall thereon, and the blade changing button 162 has an end corresponsively engaged with the left case 16 and the other end penetrating through the left case 16 and extending out from an outer side of the left case 16, and the locking hole 32 is corresponsively sheathed on a back structure of an end of the blade changing button 162 extended out from the left case 16. The present invention can use the blade changing button 162 to eject the locking structure of the blade holder 2 in the locking hole 32 to achieve the effect of disengaging the blade 3 from the blade holder 2, so as to change the blade 3. During use, the users simply need to push the movable pushbutton 4 to push the blade 3 to its maximum extension, and use a thumb to press the part of the blade changing button 162 protruded from the left case 16, so that the blade changing button 162 can eject the locking structure between the blade 3 and the blade holder 2 to achieve the effect of changing a blade.

In FIGS. 7 and 8, the adjusting device 52 comprises a stop screw 521' and a lock knob 523', and the lock knob 523' has a threaded hole 5231' coaxially matched with the stop screw 521'; the case 1 has a knob socket 19 formed at a bottom end thereof and matched with the lock knob 523'; the lock knob 523' is corresponsively engaged into the knob socket 19; a front end of the stop screw 521' is corresponsively and fixedly coupled to a rear and of the locking rod 51, and the rear end of the stop screw 521' and the threaded hole 5231' of the lock knob 523' are corresponsively coupled by a screw thread; the locking rod 51 is coupled by the screw thread between the lock knob 523' and the stop screw 521' to adjust an extension/retraction movement in a direction with respect to the blade extension/retraction opening 11. In the present invention, the screw thread structure is provided for driving the locking rod 51 to perform an extension/retraction movement under the adjustment effect of the lock knob 523' by the stop screw 521', and the oblique bump 161 is provided for reducing the gap from the blade 3 to lock the blade 3 tightly, limiting the extension/retraction movement of the blade 3, and preventing the blade 3 from shaking in the gap. As a result, no additional force is required to limit the blade 3 while using the utility knife, and users can use the utility knife more easily and conveniently. Wherein, the locking rod 51 has a guide groove 511 formed along the extension/retraction movement direction, and the left case 16 has a guide protrusion 163 formed on an inner wall thereof and matched with the guide groove 511; the locking rod 51 is positioned by the guide groove 511 and the guide protrusion 163 to limit the extension and retraction direction of the locking rod 51.

The utility knife of the invention adopts the locking rod 51 to reduce the gap from the blade 3 in order to achieve the functions of clamping and locking the blade 3 tightly; wherein the adjusting device 52 can be a movable pushbutton linked with the locking rod 51, and the movable pushbutton is installed at the back of the case 1 and has a chute matched with the movable pushbutton for driving the locking rod 51 to perform an extension/retraction movement, so as to achieve the effects of reducing the distance between the top end of the locking rod 51 and the blade 3 by the oblique structure to clamp and lock the blade 3 tightly. In addition, the adjusting device 52 can be a device for adjusting the interval between the locking rod 51 and the blade 3. By adjusting the locking rod 51 to a position attached tightly with the blade 3, the blade 3 can be locked securely. For example, the back of the case 1 has a knob coupled perpendicularly with a screw thread, and an end of the knob is corresponsively fixed and coupled to the back of the locking rod 51, and the adjusting device 52 may be a linkage mechanism for linking the locking rod 51 by a gear structure.

Figure 9:
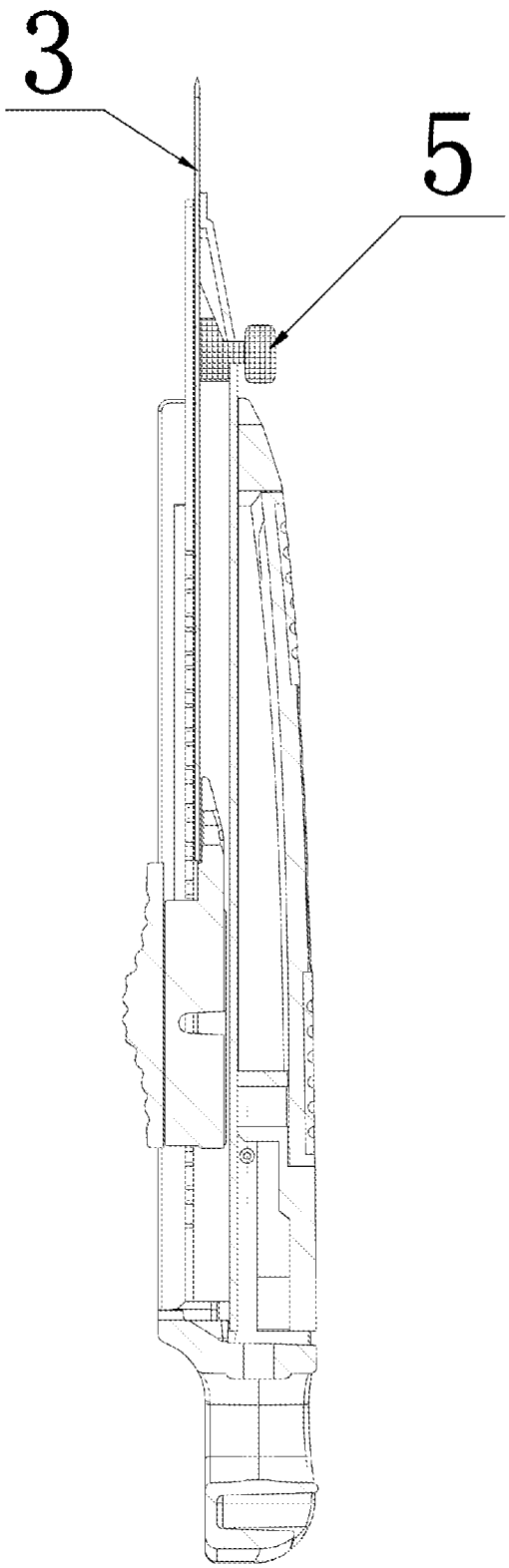
FIG. 9 is a schematic view of a utility knife having a locking device which is a knob with a top block in accordance with the present invention.

In FIG. 9, the locking device 5 is a top block having a knob, wherein the locking device 5 and the back of the case 1 are coupled by a screw thread, and the knob is installed on an outer side of the back of the case 1, and the top block is installed on an inner side of the back of the case 1 and spaced from the blade 3. The knob is rotate to lift the top block to achieve the effect of eliminating the gap from the blade 3, so as to clamp and lock the blade 3 tightly. In addition, a metal plate is installed between the top block and the blade 3, wherein the gap between the metal plate and the blade 3 will be decreased with its linkage with the top block gradually during the rotation of the screw thread until the gap no longer exists, so that the metal plate can have the effect of locking the blade 3 effectively. In addition, the locking device 5 and the back of the case 1 are rotatably and movably engaged with each other, and the thickness of the periphery of the top block varies. By rotating the knob, a thick edge of the top block can be combined with the bevel 211 to eliminate the gap from the blade 3, so as to clamp and lock the blade 3 tightly.

Figure 10:
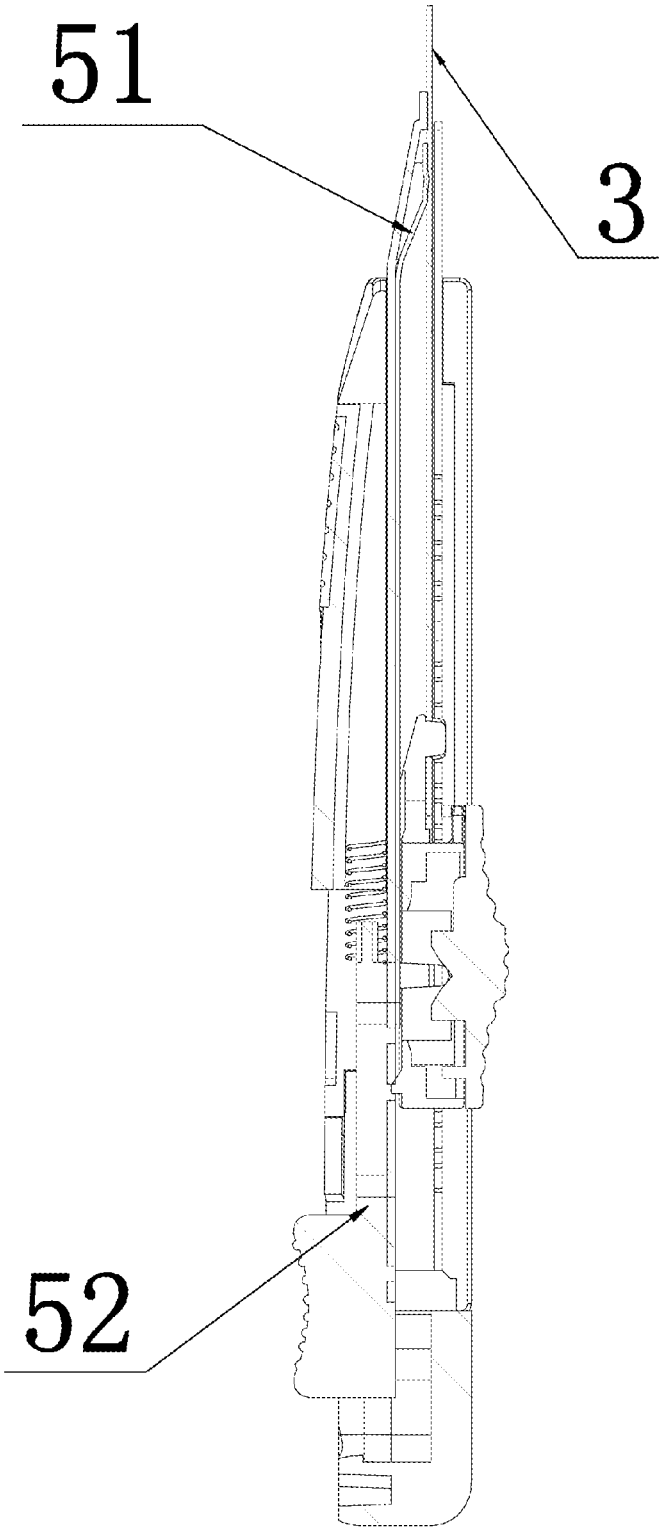
FIG. 10 is a schematic view of a utility knife having an adjusting device which is a pushbutton structure in accordance with the present invention.
Figure 11:
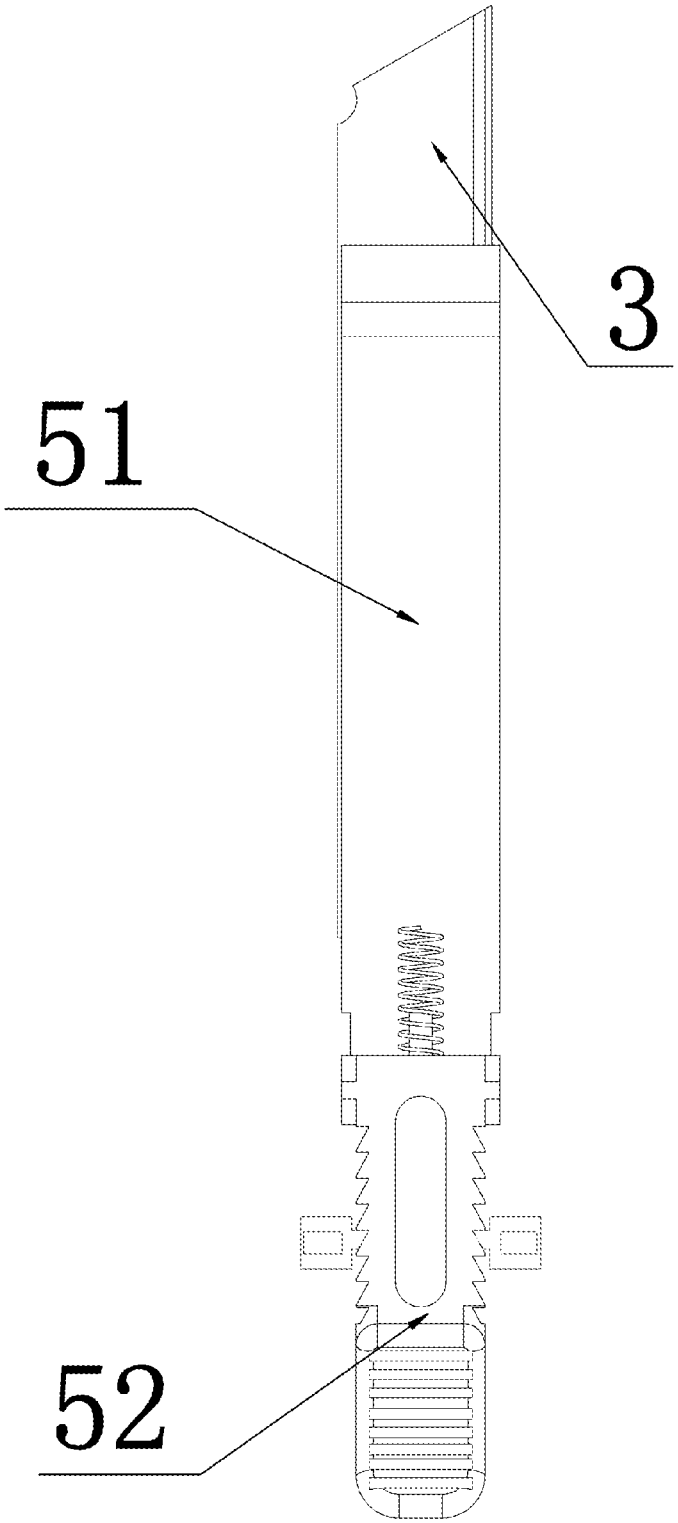
FIG. 11 is a schematic view of an adjusting device of a pushbutton structure in accordance with the present invention.

In FIGS. 10 and 11, the adjusting device 52 of this embodiment comprises an adjusting pushbutton, a lock plate with a locking rack installed separately on both sides thereof and two symmetrically distributed elastic lock stopping blocks disposed on both sides of the lock plate separately and matched with the locking rack. Both ends of the lock plate are respectively and corresponsively coupled to the adjusting pushbutton and the locking rod 51; and an end of the lock plate corresponsively coupled to the locking rod 51 is further corresponsively coupled to the case 1 by a compression spring. By pushing the adjusting pushbutton to drive the lock plate to overcome the elastic force of the elastic lock stopping block and drive the locking rod 51 to perform an extension/retraction movement, so as to achieve the effects of reducing the distance between the top end of the locking rod 51 and the blade 3 by the oblique structure, and clamping and locking the blade 3 tightly, wherein the elastic lock stopping block can lock the lock plate, so that the locking rod 51 is situated at a locked state. After the elastic lock stopping block is opened manually, the locking rod 51 is driven under the action force of the compression spring, and both of the lock plate and the adjusting pushbutton are retracted to release the blade 3.

Figure 12:
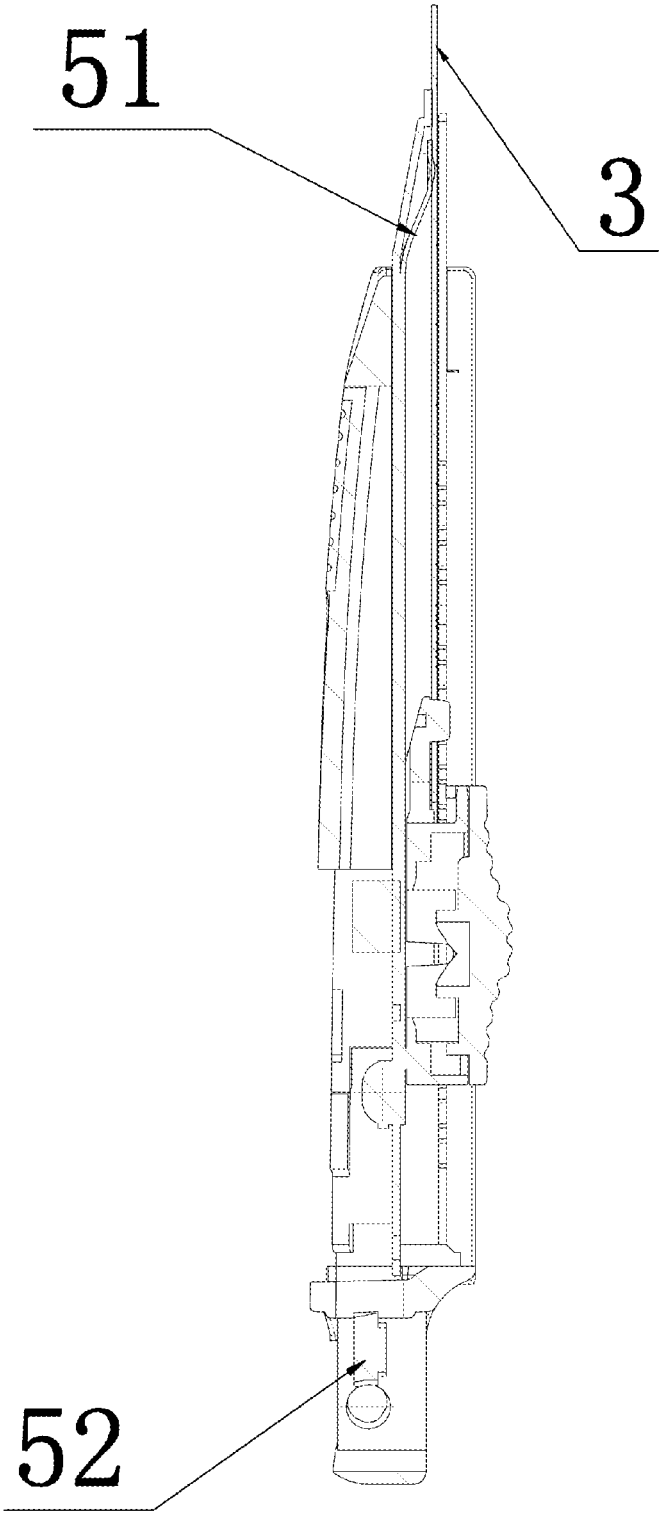
FIG. 12 is a schematic view of a utility knife having an adjusting device which is a worm transmission structure in accordance with the present invention.
Figure 13:
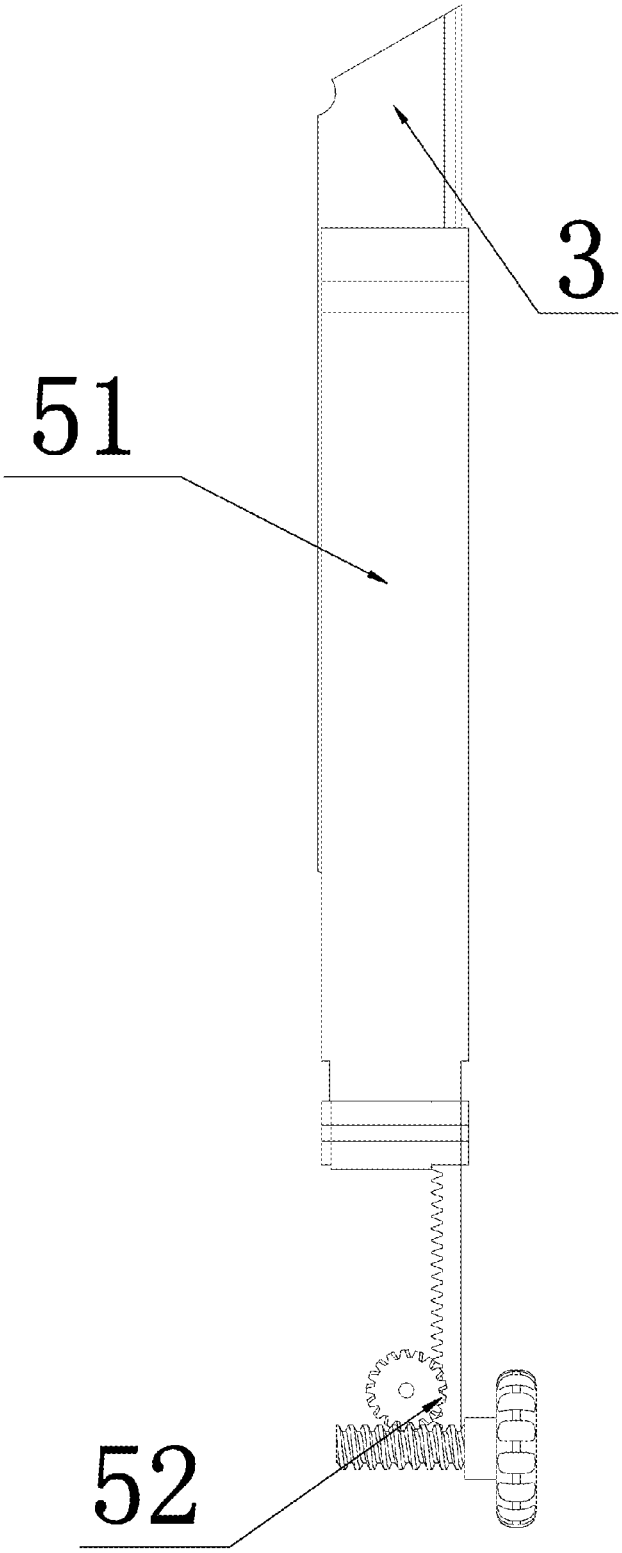
FIG. 13 is a schematic view of an adjusting device of a worm transmission structure in accordance with the present invention.

In FIGS. 12 and 13, the adjusting device 52 of this embodiment further comprises a worm knob, a worm integrally coupled and coaxially configured with the worm knob, a gear matched, transmitted, and coupled with the worm, and a rack matched, transmitted, and coupled with the gear, and the top end of the rack and the bottom end of the locking rod 51 are corresponsively coupled to each other. By rotating the worm knob to drive the worm to rotate accordingly, the rotation of the gear results in the extension/retraction movement of the rack, and thus driving the locking rod 51 to perform an extension/retraction movement, and achieve the effects of reducing the distance between the top end of the locking rod 51 and the blade 3 by the oblique structure and clamping and locking the blade 3 tightly.

Figure 14:
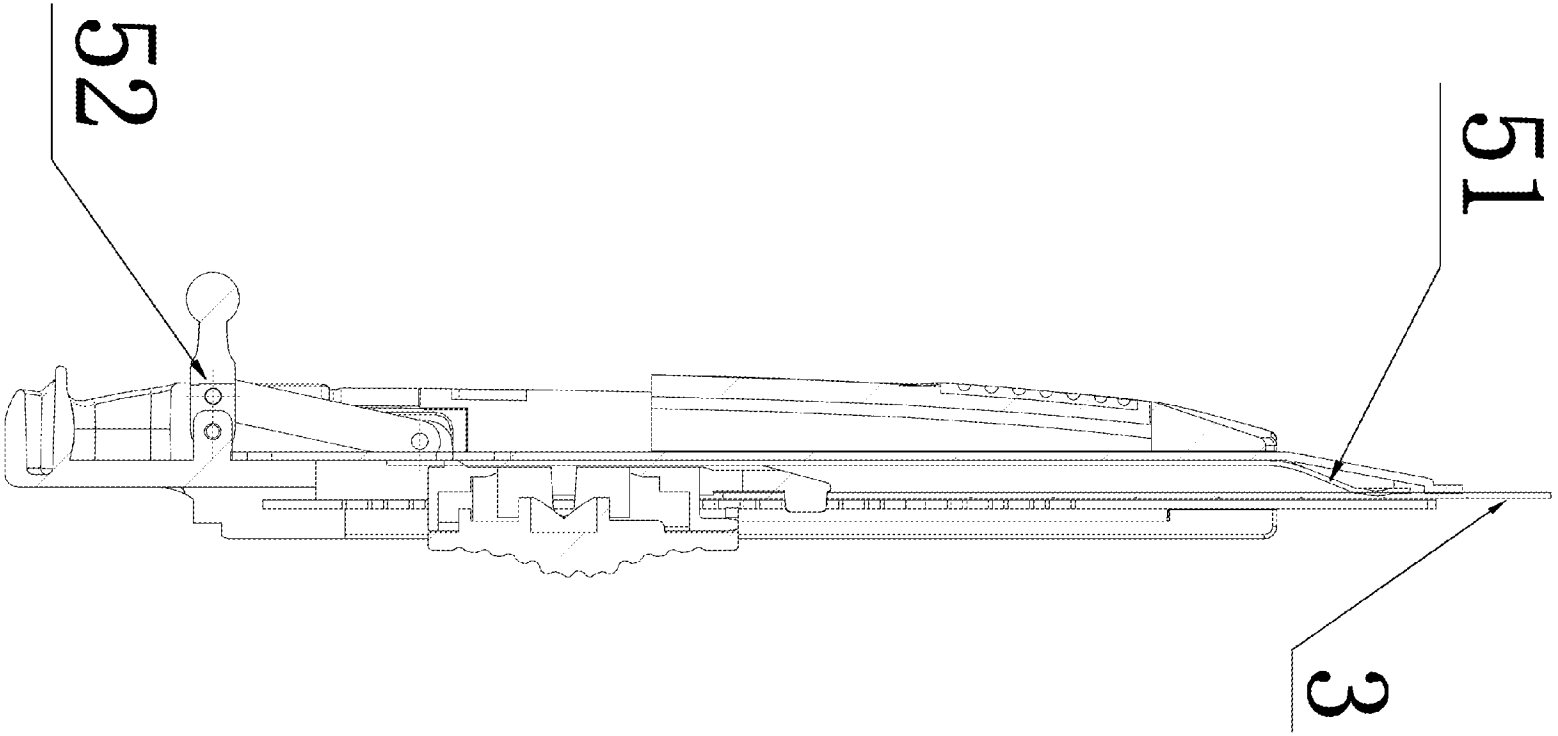
FIG. 14 is a schematic view of a utility knife structure having an adjusting device which is lock stopping press handle in accordance with the present invention.
Figure 15:
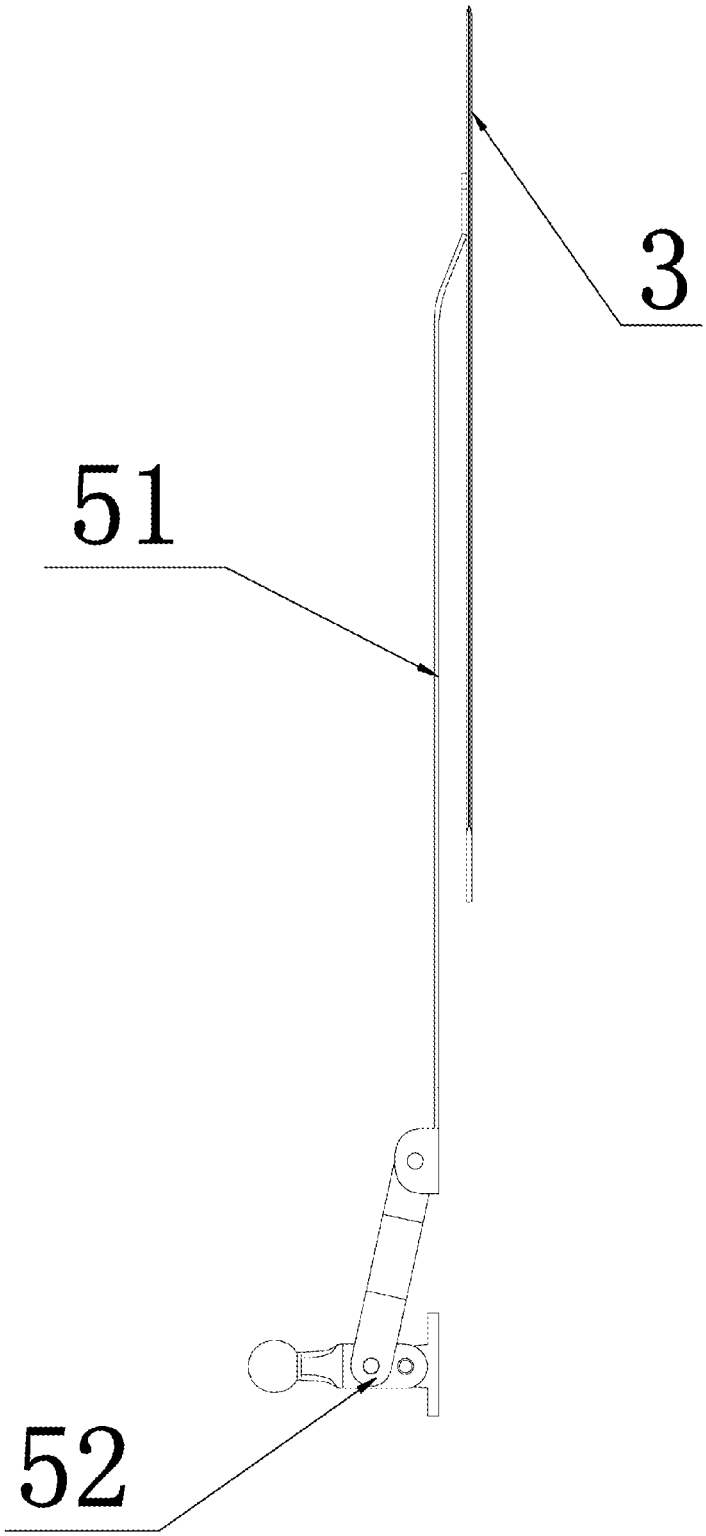
FIG. 15 is a schematic view of an adjusting device of a lock stopping press handle in accordance with the present invention.
Figure 16:
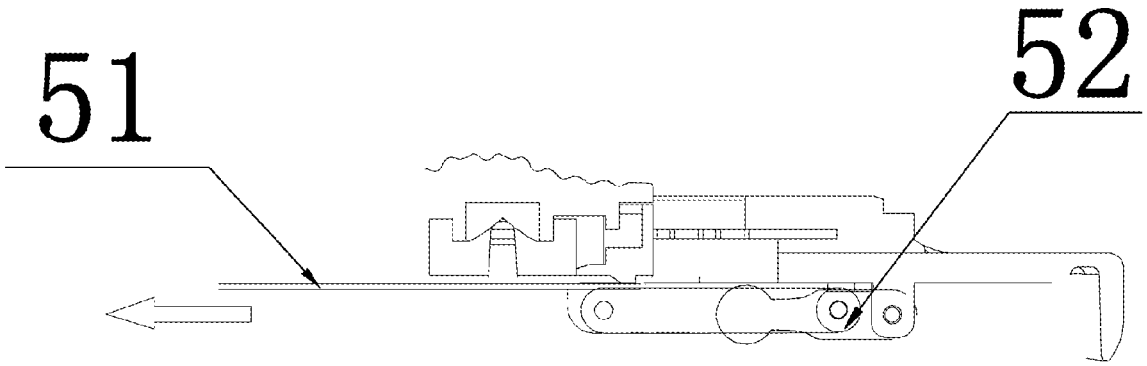
FIG. 16 is a schematic view of an adjusting device which is a lock stopping press handle when the blade is in a locked state in accordance with the present invention.
Figure 17:
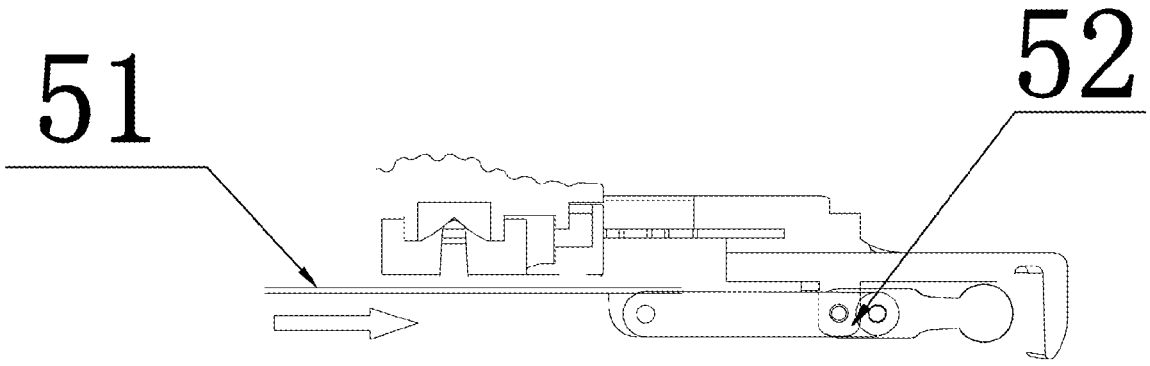
FIG. 17 is a schematic view of an adjusting device which is a lock stopping press handle when the blade is in an unlocked state in accordance with the present invention.

In FIGS. 14 and 15, the adjusting device 52 of this embodiment comprises a lock stopping press handle corresponsively hinged with the case 1, and a link rod installed separated at both ends thereof and corresponsively hinged with an end of the locking rod 51 and the middle of the lock stopping press handle. In FIG. 16, when the lock stopping press handle is pushed forward, the link rod is driven to push the locking rod 51 to extend to the front and reduce the distance between the top end of the locking rod 51 and the blade 3 by the oblique structure to clamp and lock the blade 3 tightly. In FIG. 17, when the lock stopping press handle is pushed backward, the link rod is pulled backward to retract the locking rod 51 and release the blade 3.

Figure 18:
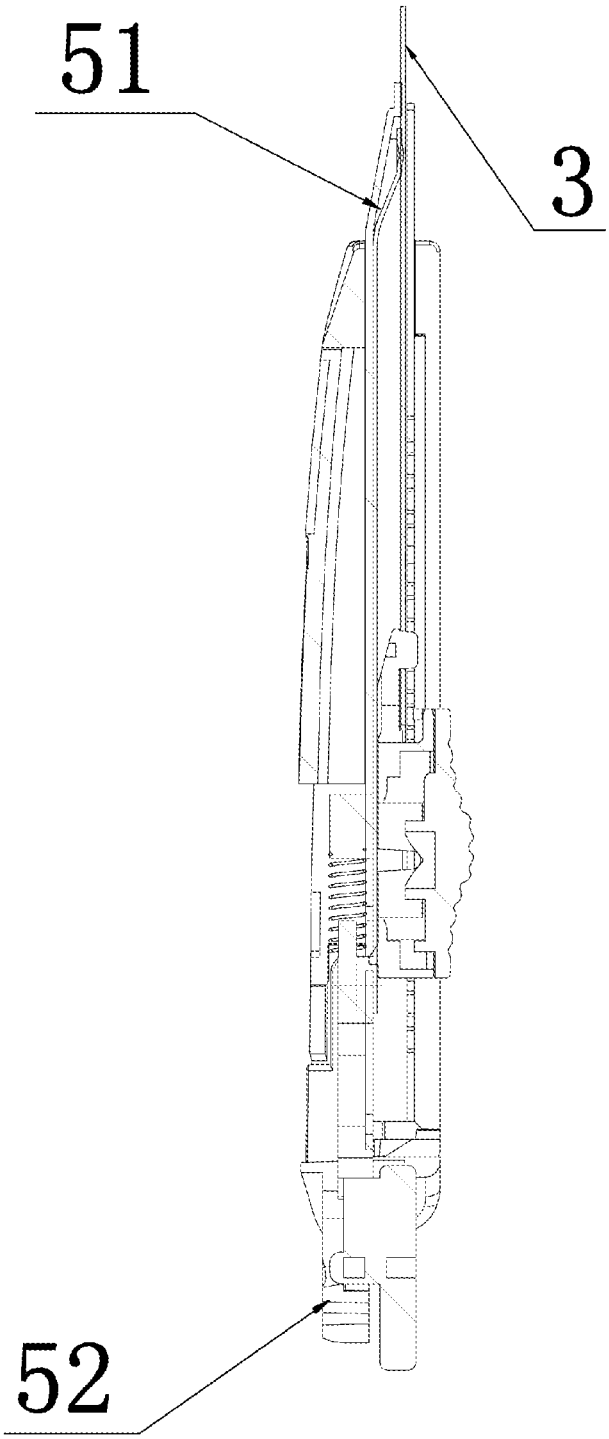
FIG. 18 is a schematic view of a utility knife having an adjusting device which is a cam transmission structure in accordance with the present invention.
Figure 19:
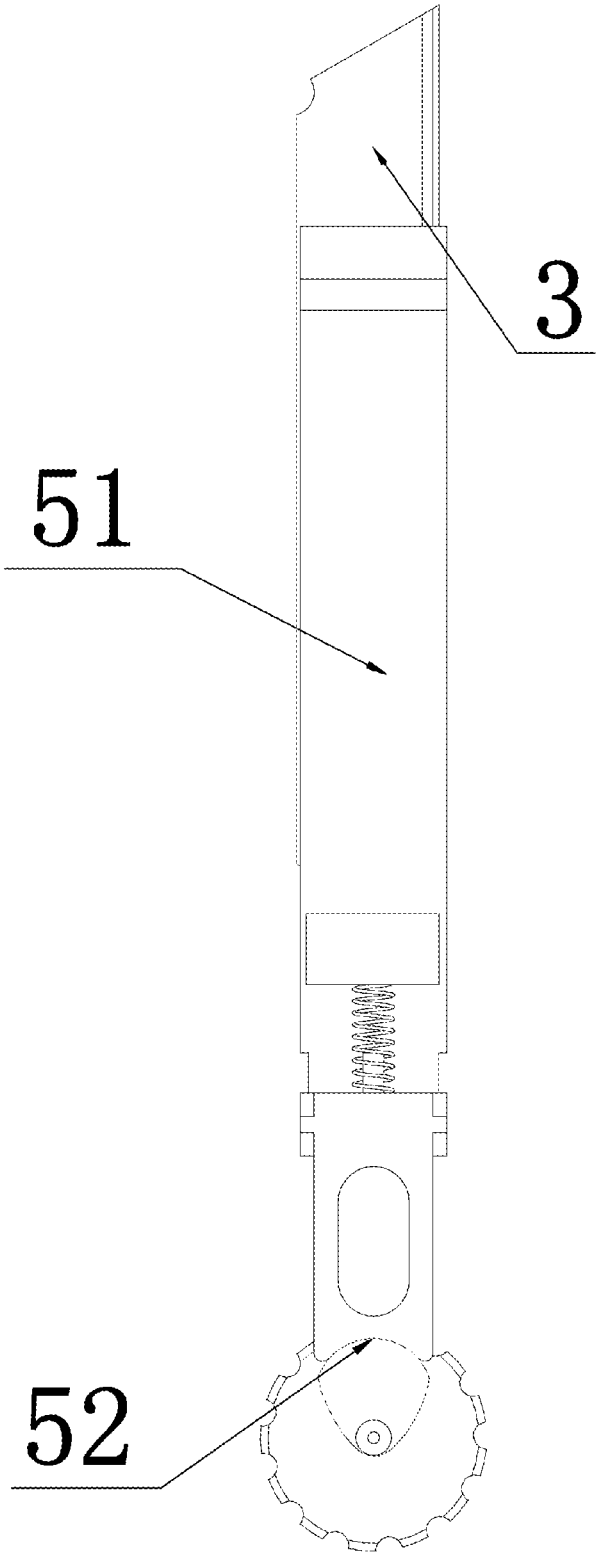
FIG. 19 is a schematic view of an adjusting device of a cam transmission structure in accordance with the present invention.
Figure 20:
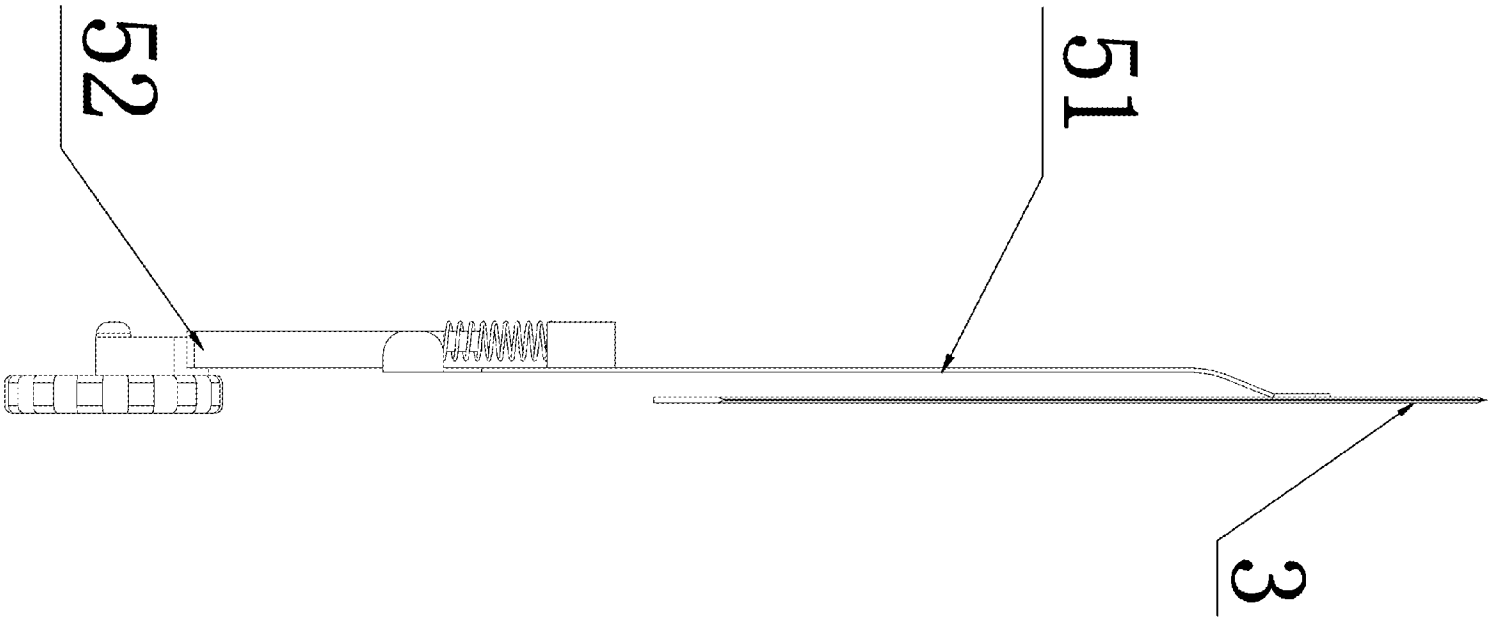
FIG. 20 is a side view of an adjusting device of a cam transmission structure in accordance with the present invention.

In FIGS. 18, 19 and 20, the adjusting device 52 of this embodiment further comprises a cam knob and a cam matched, rotated, transmitted and coupled with the cam knob, and an end of the cam knob props a cam linking rod of the cam, and the cam linking rod has a top end corresponsively coupled to an end of the locking rod 51, and the top end of the cam linking rod is further corresponsively coupled to the case 1 by a compression spring. The utility knife uses the rotation of the cam knob to drive the cam to rotate. The distance between the contact point of the cam and the cam linking rod and the axial line of the cam knob keeps changing during the process, the change of distance drives the cam linking rod to extend or retract, so as to drive the locking rod 51 to perform an extension/retraction movement, and achieve the effects of reducing the distance between the top end of the locking rod 51 and the blade 3 by the oblique structure and clamping and locking the blade 3 tightly, wherein the compression spring under the action force is provided for keeping the cam linking rod to press the cam.

While the invention has been described by means of specific embodiments, numerous modifications and variations could be made thereto by those skilled in the art without departing from the scope and spirit of the invention set forth in the claims

What is claimed:

1. A utility knife, comprising: a case, a blade holder, a blade, a movable pushbutton and a locking device, characterized in that the case comprises a blade extension/retraction opening formed at a front end thereof and provided for the blade to extend or retract and a chute formed on a side of the case and provided for the movable pushbutton to move; the blade is correspondingly installed into the case through the blade holder, and the blade is controlled by the movable pushbutton to perform an extension or retraction at the blade extension/retraction opening; the locking device comprises a locking rod and an adjusting device, and the locking rod is adjusted by the adjusting device to lock the blade, wherein the case further comprises: a blade holder slidable mounting groove formed on a front side of the case, penetrating through a bottom of the case and the blade extension/retraction opening, and matched with the blade holder, a blade chute formed on a front side of the blade holder, penetrating the front side and a rear side of the blade holder, and matched with the blade, and a bevel upwardly formed at the bottom of a front section of the blade chute, the blade holder being plugged from a rear end of the blade holder slidable mounting groove of the case into a position corresponsively matched and coupled to the case, a rear end of the blade corresponsively matched and coupled to the movable pushbutton and being movably installed into the blade chute of the blade holder, and the movable pushbutton being exposed from top notches of the blade chute and the blade holder slidable mounting groove, the locking rod being installed between the bottom of the blade chute and the blade, and the adjusting device being installed at a rear end of the case, the locking rod performing an extension/retraction movement in the blade chute by the control of the adjusting device, and a front end of the locking rod reducing the gap between the locking rod and the blade by the bevel to lock the blade tightly.

2. The utility knife as claimed in claim 1, wherein the blade chute of the blade holder has a plurality of symmetrically distributed locking serrated slots formed on two parallel sides thereof; the movable pushbutton comprises a bottom plate, a reset elastic plate, a locking shaft and a pushing portion; the bottom plate has a bump disposed at a front end thereof, and the blade has a hole formed at the rear end thereof and matched with the bump; the bottom plate has an elastic plate mounting slot formed at a front side of a rear end thereof and matched with the reset elastic plate, and the elastic plate mounting slot further has an axis positioning slot formed thereon, perpendicularly intersected and matched with the locking shaft; the pushing portion has a V-shaped groove formed at a bottom end thereof and matched with the locking shaft; the reset elastic plate is corresponsively installed into the elastic plate mounting slot of the bottom plate; the locking shaft is corresponsively installed into the axis positioning slot and disposed on the reset elastic plate, and a part of the locking shaft is protruded from a side of the bottom plate; the pushing portion is corresponsively latched onto the bottom plate, and the V-shaped groove is corresponsively sheathed onto the part of the bottom plate protruded from the locking shaft; the rear end of the blade and the movable pushbutton are coupled by the corresponsive engagement between the bump and the hole; when no force is exerted onto the movable pushbutton, the part of the end of the locking shaft protruded from the bottom plate is corresponsively engaged with the locking serrated slot; when a force is exerted onto the movable pushbutton to push the movable pushbutton, a downward component force of the V-shaped groove squeezes and compresses the locking shaft to overcome the elastic force of the reset elastic plate, so as to deform and dent the reset elastic plate, while the locking shaft is being squeezed and pressed into the axis positioning slot, so that the locking shaft and the locking serrated slot are detached from each other.

3. The utility knife as claimed in claim 1, wherein the adjusting device comprises a stop screw, a stop bracket and a lock knob; the stop bracket is a U-shaped structure, and a U-shaped open end of the stop bracket and the rear end of the locking rod are corresponsively hinged with each other; the lock knob has a threaded hole formed thereon and coaxially matched with the stop screw; and the stop bracket has a knob snapping slot formed on a U-shaped closed end side thereof and matched with the lock knob, and the stop bracket has a screw socket formed on a U-shaped open bottom thereof, penetrating through the knob snapping slot, and matched with the stop screw; the lock knob is corresponsively engaged with the knob snapping slot of the stop bracket, and the lock knob in the knob snapping slot can rotate freely about an axis which is the axial line of the lock knob, and both of the threaded hole and the screw socket are coaxially distributed; the stop screw is corresponsively fixed to the rear end of the case, and the screw thread of the stop screw is configured in a direction opposite to the blade extension/retraction opening; the blade holder slidable mounting groove has a bracket moving slot formed separately on opposing sides of the rear end thereof and matched with the stop bracket; the locking rod achieves an extension/retraction movement in the blade chute by adjusting a screw thread connection between the lock knob and the stop screw.

4. The utility knife as claimed in claim 3, wherein the case has a stopping and positioning notch formed separately on top and bottom sides of the rear end thereof, and the stop bracket has a stop positioning block disposed separately on top and bottom sides thereof and matched with the stopping and positioning notch; when the gap between the front end of the locking rod and the blade is reduced by the bevel to lock the blade tightly, the stopping and positioning notch and the stop positioning block have a corresponding gap formed therebetween.

5. The utility knife as claimed in claim 1, wherein the case comprises an outer case and an inner case; both of the blade extension/retraction opening and the blade holder slidable mounting groove are disposed on the outer case, and the blade holder slidable mounting groove has a case socket formed at the bottom thereof and matched with the inner case; the inner case has a blade holder chute matched with the blade holder; after the inner case is corresponsively engaged with the case socket, the inner case passes through the blade holder and penetrates through the blade holder slidable mounting groove and the blade holder chute to fix the inner case onto the outer case.

6. A utility knife, comprising: a case, a blade holder, a blade, a movable pushbutton and a locking device, characterized in that the case comprises a blade extension/retraction opening formed at a front end thereof and provided for the blade to extend or retract; the blade is correspondingly installed into the case through the blade holder, and the blade is controlled by the movable pushbutton to perform an extension or retraction at the blade extension/retraction opening; the locking device comprises a locking rod and an adjusting device, and the locking rod is adjusted by the adjusting device to lock the blade; wherein the case comprises a left case and a right case engaged sideway and fixed with each other, and the right case has a blade holder sliding groove formed on an inner wall thereof, penetrating through the blade extension/retraction opening, and matched with the blade holder; the case has a movable pushbutton chute formed at a top side thereof, penetrating through the blade holder sliding groove, and matched with the movable pushbutton; the left case has an oblique bump disposed on an inner wall thereof and at a position near the blade extension/retraction opening; the blade is fixedly engaged with the blade holder, and the blade holder carrying the blade is corresponsively installed to the blade holder sliding groove; the movable pushbutton is corresponsively linked and coupled to the blade holder and exposed from the case at a position of the movable pushbutton chute; the locking rod is installed between the inner wall of the left case and the blade, and the adjusting device is installed at a rear end of the case; the locking rod achieves an extension/retraction movement in a direction with respect to the blade extension/retraction opening by the control of the adjusting device, and a front end of the locking rod reduces the gap between the locking rod and the blade by the oblique bump to lock the blade tightly.

7. The utility knife as claimed in claim 6, wherein the movable pushbutton comprises a connecting rod and a pushing portion integrally coupled with each other, and the blade holder has a linkage socket formed thereon for corresponsively sheathing on the connecting rod; the blade holder sliding groove of the right case has a plurality of equidistant positioning serrated slots formed at a top edge thereof, and a plurality of positioning bumps disposed at a side edge of the connecting rod and corresponsively matched with the positioning serrated slots respectively; the movable pushbutton achieves a linkage and connection with the blade holder by corresponsively sheathing the linkage socket on the connecting rod, and the axial direction of the linkage socket is in the direction of an opening of the movable pushbutton chute; the pushing portion is exposed from the case at the position of the movable pushbutton chute; a reset elastic member having a direction of action force which is the same as the axial direction of the linkage socket is installed between the movable pushbutton and the blade holder, and one of the positioning bumps is engaged with one of the positioning serrated slots under the action force of the reset elastic member; when the movable pushbutton is pressed, the movable pushbutton overcomes a downward reset force of the reset elastic member, so that the positioning bump is detached from the positioning serrated slot, so as to push the movable pushbutton to drive the blade holder with the blade to perform an extension/retraction movement in the blade holder sliding groove; when the blade is retracted to a position to release the movable pushbutton, the positioning bump under the reset force of the reset elastic member is engaged with the positioning serrated slot.

8. The utility knife as claimed in claim 7, wherein the blade has a locking hole formed thereon and corresponsively engaged with the blade holder; the left case has a blade changing button installed on an inner sidewall thereon, and the blade changing button has one end corresponsively engaged with the left case and the other end penetrating through the left case and extending out from an outer side of the left case, and the locking hole is corresponsively sheathed on a back structure of the other end of the blade changing button extended out from the left case.

9. The utility knife as claimed in claim 6, wherein the adjusting device comprises a stop screw and a lock knob, and the lock knob has a threaded hole coaxially matched with the stop screw; the case has a knob socket formed at a bottom end thereof and matched with the lock knob; the lock knob is corresponsively engaged into the knob socket; a front end of the stop screw is corresponsively and fixedly coupled to a rear end of the locking rod, and the rear end of the stop screw and the threaded hole of the lock knob are corresponsively coupled by a screw thread; the locking rod is coupled by the screw thread between the lock knob and the stop screw to adjust an extension/retraction movement in a direction with respect to the blade extension/retraction opening.

* * * * *